US008027626B2

(12) United States Patent
Miwa

(10) Patent No.: US 8,027,626 B2
(45) Date of Patent: Sep. 27, 2011

(54) IMAGE FORMING APPARATUS

(75) Inventor: Atsushi Miwa, Aichi (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 408 days.

(21) Appl. No.: 12/401,759

(22) Filed: Mar. 11, 2009

(65) Prior Publication Data

US 2009/0232566 A1 Sep. 17, 2009

(30) Foreign Application Priority Data

Mar. 11, 2008 (JP) ..... 2008-061186

(51) Int. Cl.
*G03G 15/20* (2006.01)

(52) U.S. Cl. ..... 399/320

(58) Field of Classification Search ..... 399/320, 399/330, 331, 328; 219/216, 469–471
See application file for complete search history.

(56) References Cited

U.S. PATENT DOCUMENTS

| | | | | |
|---|---|---|---|---|
| 3,834,861 | A * | 9/1974 | McCarroll | 219/216 |
| 3,876,317 | A * | 4/1975 | Jordon | 399/330 |
| 4,121,089 | A * | 10/1978 | Bishop | 219/216 |
| 4,145,181 | A * | 3/1979 | Edwards et al. | 399/330 |
| 4,147,501 | A * | 4/1979 | Goshima et al. | 399/330 |
| 4,905,050 | A * | 2/1990 | Derimiggio et al. | 399/331 |
| 2001/0052258 | A1 * | 12/2001 | Ehrlich et al. | |
| 2003/0047407 | A1 | 3/2003 | Murano et al. | |

FOREIGN PATENT DOCUMENTS

| | | |
|---|---|---|
| JP | 07-072672 | 3/1995 |
| JP | 07-332351 | 12/1995 |
| JP | 08-006470 | 1/1996 |
| JP | 08-086338 | 4/1996 |
| JP | 08-262826 | 10/1996 |
| JP | 08-305259 | 11/1996 |
| JP | 10-184663 | 7/1998 |
| JP | 2003-148516 | 5/2003 |
| JP | 2005-043823 | 2/2005 |

OTHER PUBLICATIONS

Notification of Reasons of Rejections for Japanese Application 2008-061186 mailed Feb. 16, 2010.
Notice of Reasons of Rejections received for Japanese Application 2008-061186 mailed Jun. 8, 2010.

* cited by examiner

*Primary Examiner* — Susan Lee
(74) *Attorney, Agent, or Firm* — Banner & Witcoff, Ltd.

(57) ABSTRACT

An image forming apparatus to form an image on a recording sheet by transferring electrophotographic developer onto the recording sheet is provided. The image forming apparatus includes a heat roller to thermally fix the transferred developer onto the recording sheet, a rotating member to convey rotation force to the heat roller, a bearing to support the rotating member rotatably, a frame in which the bearing is assembled so that the rotating member is supported by the frame through the bearing. The bearing is made of a material having sliding resistance lower than sliding resistance of a material of the frame. The bearing is arranged on an opposite side of the heat roller with respect to the frame and receives the rotating member on the opposite side. The bearing and the frame are assembled to have clearance therebetween.

8 Claims, 9 Drawing Sheets

A−A
29A
29
26
26A
30
23A
31
A
23

30E
30D
30A
26A
23
30A
31
HEAT ROLLER SIDE
30D
23A
23B
30
30F
23A
30E
F1

B−B

HEAT ROLLER SIDE
D
A
23A
23
23B
30
30A
30D
30E
30F
26
26A
29
29A
31
15A
15B

IMAGE FORMING APPARATUS

CROSS REFERENCE TO RELATED APPLICATION

This application claims priority from Japanese Patent Application No. 2008-061186, filed on Mar. 11, 2008, the entire subject matter of the which is incorporated herein by reference.

BACKGROUND

1. Technical Field

An aspect of the present invention relates to an image forming apparatus capable of electrophotographically forming an image with components having higher heat-resistance and friction-resistance.

2. Related Art

An image forming apparatus is configured with various components including rollers and gears, which rotate about shafts supported by bearings. As the shafts rotate in the bearings, frictional heat is caused, and the bearings may be deformed by the frictional heat.

In order to avoid the heat-deformation, for example, Japanese Patent Provisional Publication No. H08-6470 suggests bearings to receive a rotatable shaft of a gear to rotate a photosensitive drum, which are made of a material having higher heat-resistance than a material to form a cartridge frame. Thus, deformation of the bearings, which may be caused by the frictional heat, can be avoided.

SUMMARY

However, an image forming apparatus to form an image electrophotographically is generally configured to transfer a latent image to a surface of a recording sheet so that the latent image is developed and heated by a heat roller to be fixed on the recording sheet. Therefore, temperatures in areas surrounding the heat roller tend to be higher, and components in the apparatus in the surrounding areas are exposed to the heat. Specifically, bearings to support rotatable members including gears and rollers can be still damaged and deformed by the heat from the heat roller in addition to the frictional heat caused by rotation even when the bearings are made of heat-resistant materials.

In view of the above drawbacks, the present invention is advantageous in that an image forming apparatus with bearings having higher heat-resistance and friction-resistance is provided.

According to an aspect of the present invention, an image forming apparatus to form an image on a recording sheet by transferring electrophotographic developer onto the recording sheet is provided. The image forming apparatus includes a heat roller to thermally fix the transferred developer onto the recording sheet, a rotating member to convey rotation force to the heat roller, a bearing to support the rotating member rotatably, a frame in which the bearing is assembled so that the rotating member is supported by the frame through the bearing. The bearing is made of a material having sliding resistance lower than sliding resistance of a material of the frame. The bearing is arranged on an opposite side of the heat roller with respect to the frame and receives the rotating member on the opposite side. The bearing and the frame are assembled to have clearance therebetween.

According to the above configuration, frictional heat which may occur in the bearing can be decreased. Therefore, resistance quality against heat deformation and abrasion of the bearing can be improved.

BRIEF DESCRIPTION OF THE ACCOMPANYING DRAWINGS

DETAILED DESCRIPTION

Hereinafter, an embodiment according to an aspect of the present invention will be described with reference to the accompanying drawings.

Figure 1:
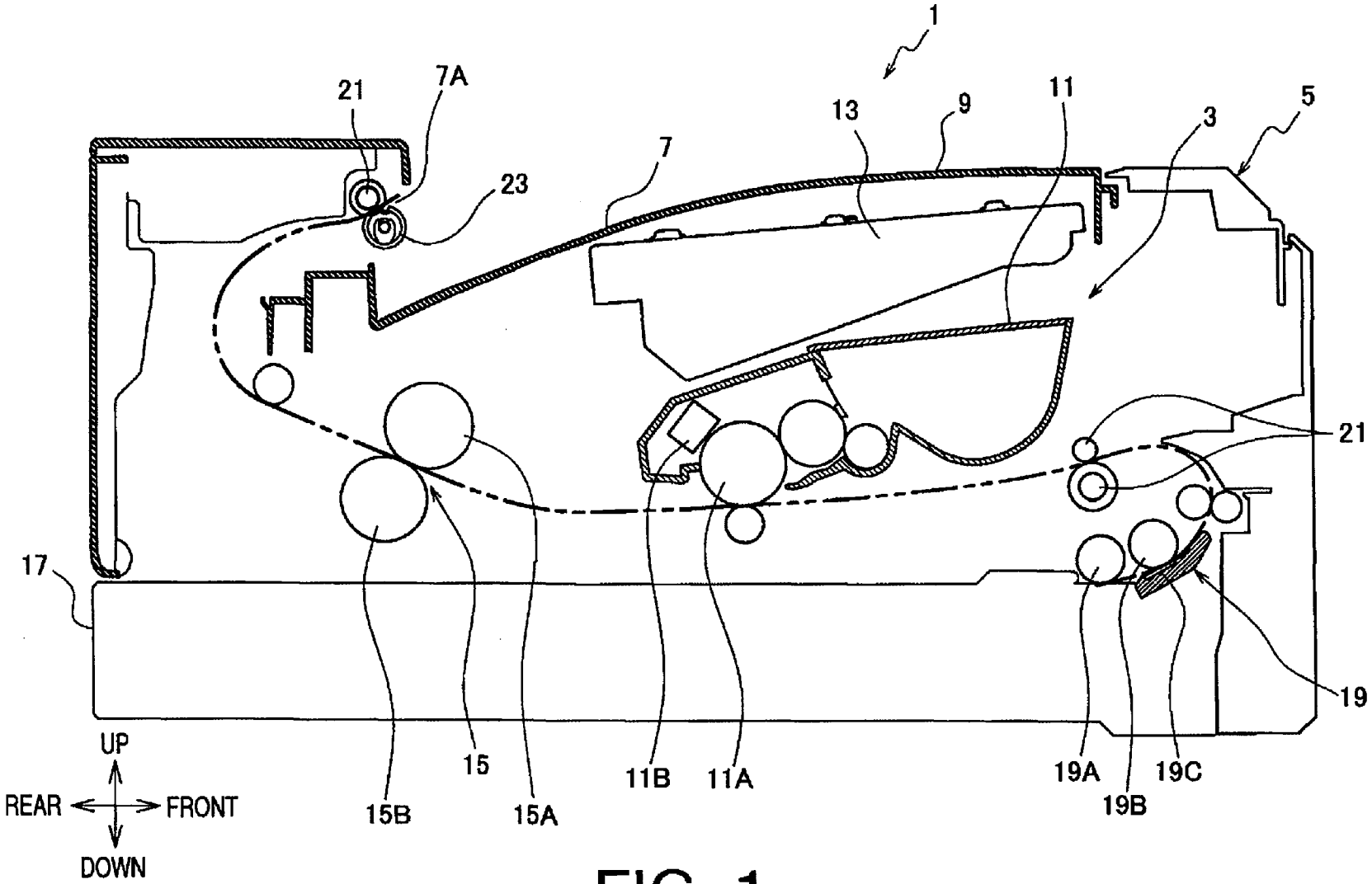
FIG. 1 is a cross-sectional side view of a laser printer according to an embodiment of the present invention.

FIG. 1 is a cross-sectional side view of a laser printer 1 according to the embodiment of the present invention. The laser printer 1 is a printer for monochrome printing and includes an image forming unit 3, which is configured to transfer a latent image to a surface of a recording sheet, develop the transferred image, and fix the developed image on the recording sheet. The recording sheet with the image formed thereon is conveyed in a sheet feeding path, which is indicated by a double-dotted line, to be discharged and received in a discharge tray 7.

The image forming unit 3 housed in a casing 5 includes a processing cartridge 11, a laser emitter unit 13, a fixing unit 15, and a feeder unit 19. The feeder unit 19 includes a sheet feed tray 17, which is detachably attached onto a bottom of the casing 5 to store a stack of recording sheets, a sheet pickup roller 19A, a separator roller 19*b*, and a sheet separator pad 19C, which are provided above one end of the sheet feed tray 17. When an image is formed, a topmost sheet in the stack of the recording sheets in the sheet feed tray 17 is separated from the stack by the sheet pickup roller 19A, the separator roller 19*b*, and the sheet separator pad 19C and straighten its orientation by a pair of register roller 21 with respect to the sheet feeding path. Further, the recording sheet is conveyed to the processing cartridge 11.

In the processing cartridge 11, a latent image is transferred to the recording sheet, which is conveyed to the fixing unit 15.

The latent image is fixed by heat onto the recording sheet in the fixing unit 15. The recording sheet is thereafter turned approximately 180 degrees toward the upper direction and discharged out of the laser printer 1.

The processing cartridge 11 includes a photosensitive drum 11A and a charger 11B to electrically charge a surface of the photosensitive drum 11A. The surface of the photosensitive drum 11A is charged by the charger 11B according to image data exposed to the laser beam emitted from the laser emitter unit 13 so that a latent image is formed on the surface of the photosensitive drum 11A. As the photosensitive drum 11A with the latent image is rotated, developer toner positively charged is provided and adhered to lower-potential regions, which correspond to the latent image, on the surface of the photosensitive drum 11A. Thus, the latent image is developed to be a reversed toner image on the photosensitive drum 11A. The reversed toner image is transferred onto the surface of the recording sheet when the recording sheet passes between the photosensitive drum 11A and a pairing roller.

Figure 2:
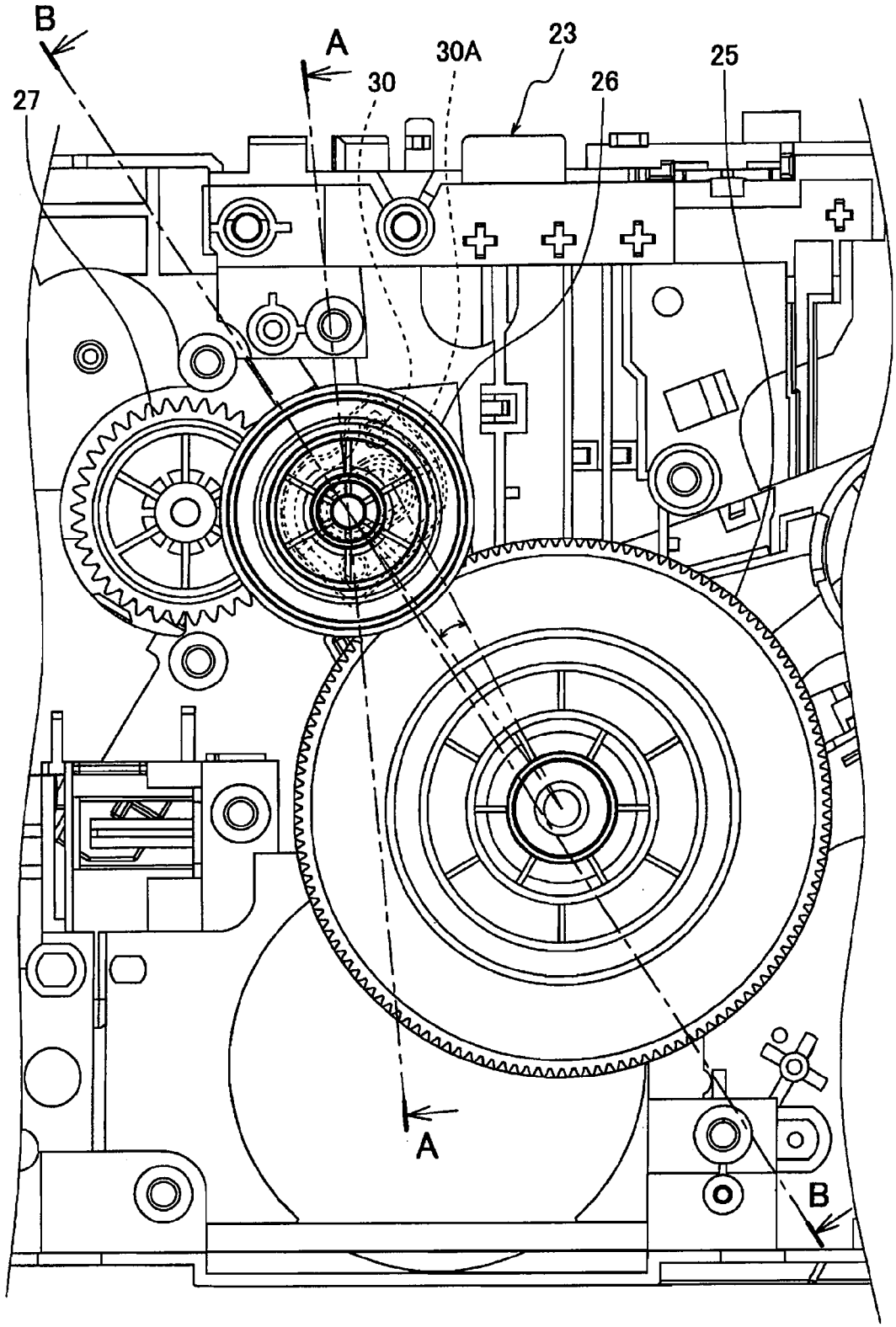
FIG. 2 is a front view of a gear train to drive a heat roller in the laser printer according to the embodiment of the present invention.

The processing cartridge 11 is detachably attached to side frames 23 (see FIG. 2), which are reinforcing parts of a main frame of the body of the laser printer 1. The side frames 23 are arranged on both sides in a widthwise direction of the laser printer 1. The side frames 23 at the both sides are connected by a beam (not shown) extending in the widthwise direction and covered with the casing 5. FIG. 2 solely shows one of the side frames 23.

The fixing unit 15 includes a heat roller 15A and a pressure roller 15B. The heat roller 15A includes a heat source (not shown), and the toner image transferred onto the recording sheet is fixed thereto by the heat from the heat roller 15A when the recording sheet passes in between the heat roller 15A and the pressure roller 15B, which is pressed to be in contact with the heat roller 15A. Axial ends of the heat roller 15*a* and the 15B are rotatably supported by the side frames 23.

Figure 6:
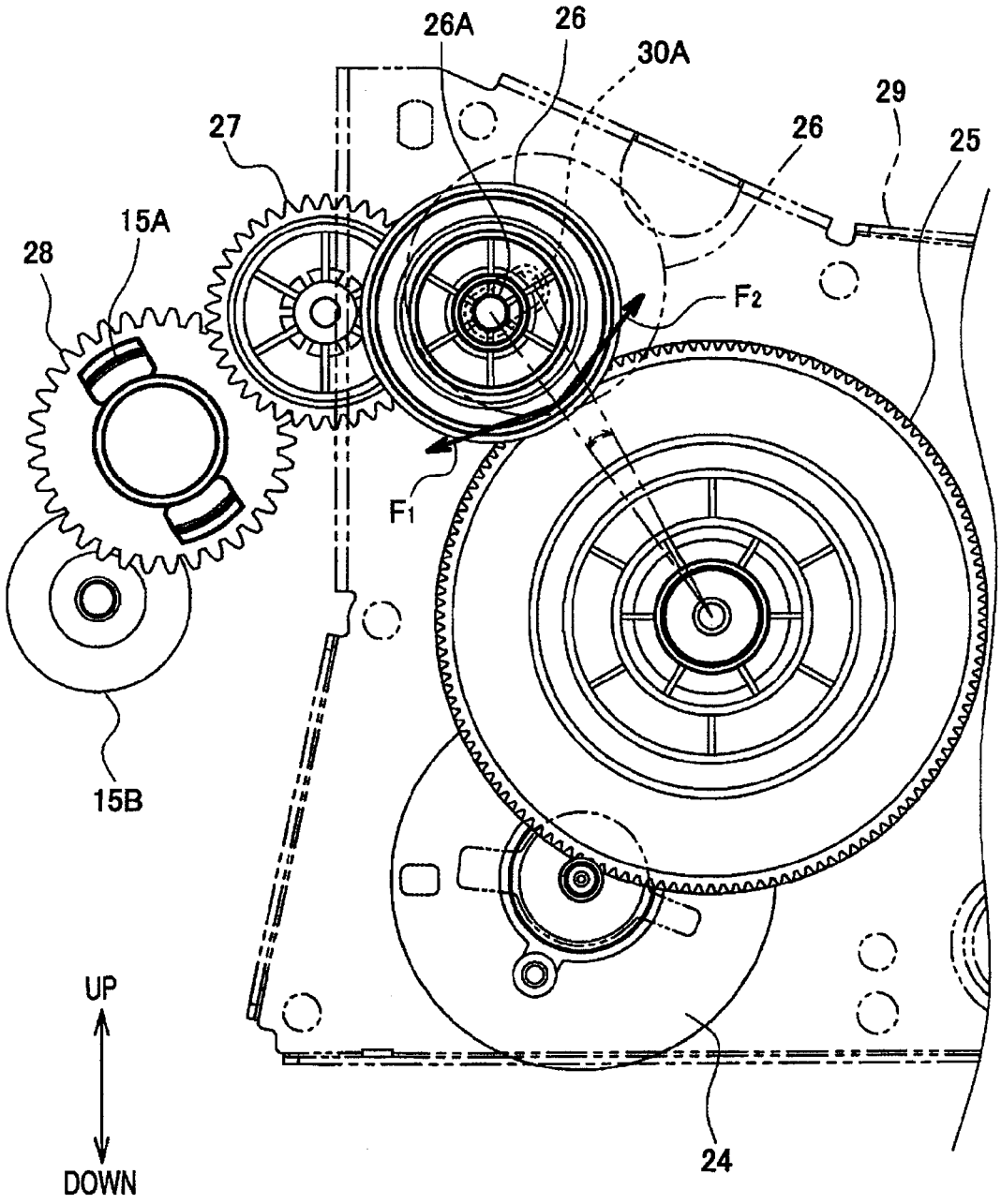
FIG. 6 is a front view of the gear train to drive the heat roller in the laser printer according to the embodiment of the present invention.

The heat roller 15A is rotated by rotating force provided by a motor 24 through a gear train including gears 25-28 (see FIG. 6). The pressure roller 15B is driven by the recording sheet being fed.

Figure 3:
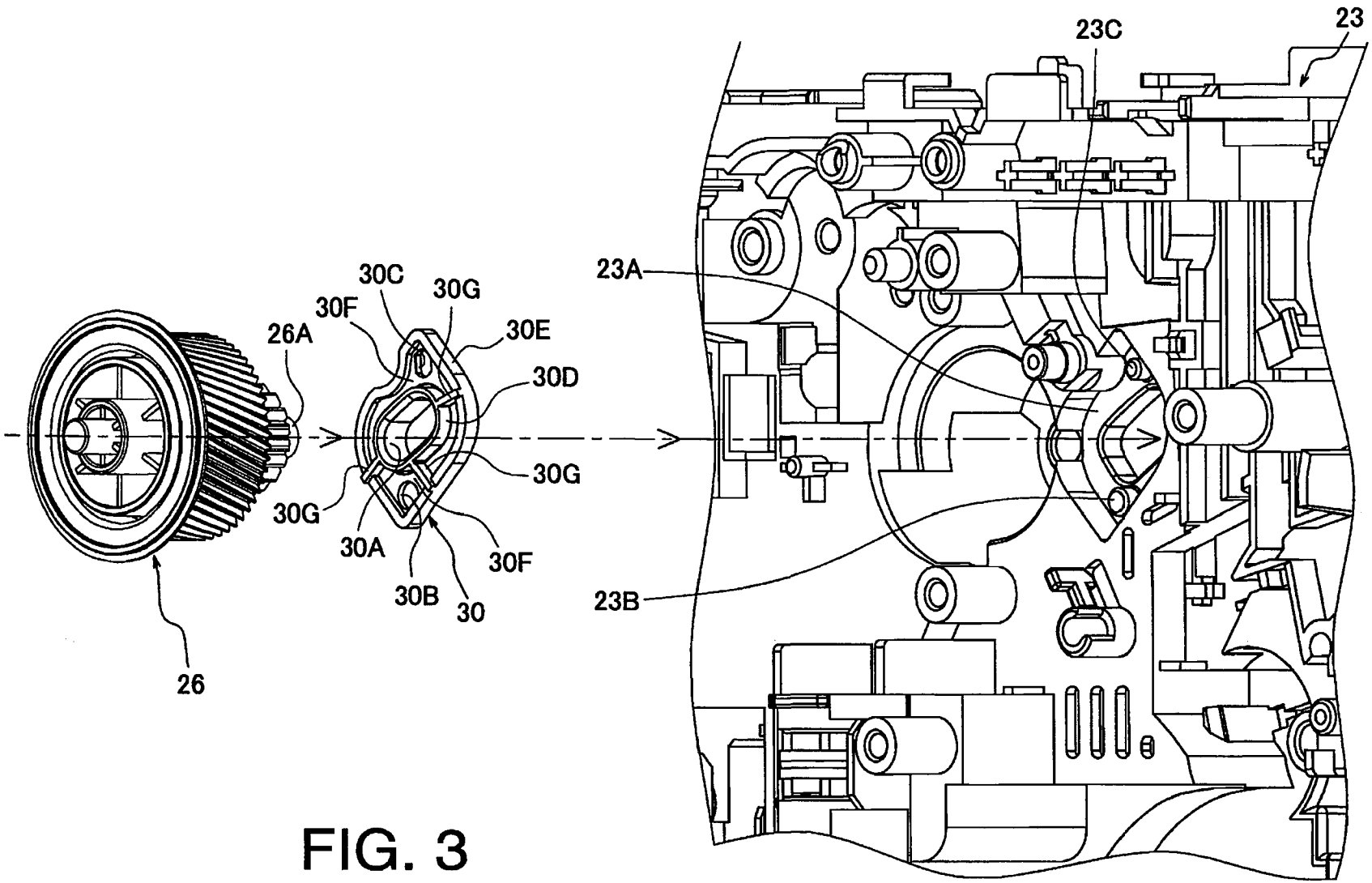
FIG. 3 is an exploded view of a clutch gear, a bearing, and a side frame in the laser printer according to the embodiment of the present invention.
Figures 4A, 4B:
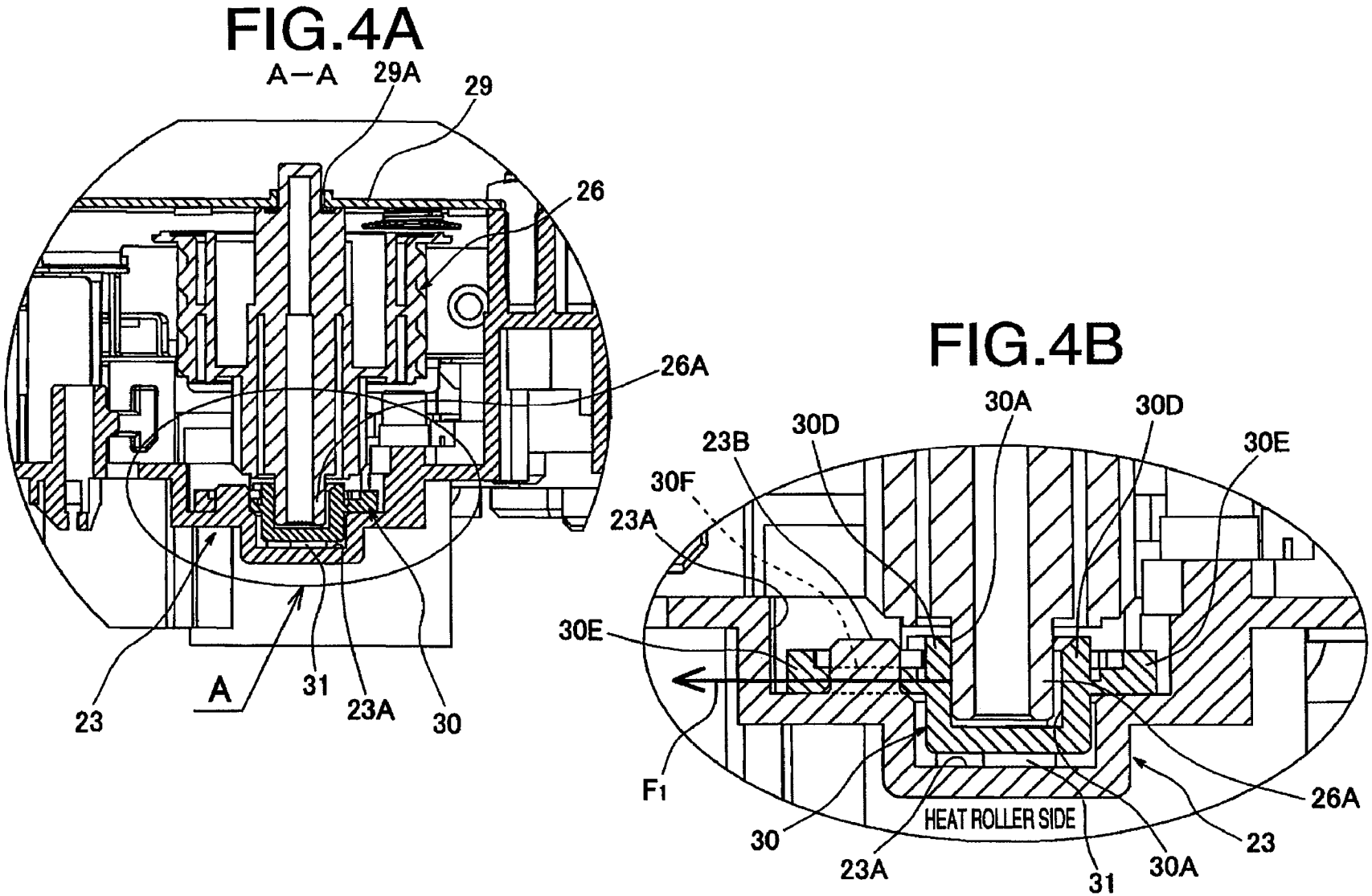
FIG. 4A is a cross-sectional view of the gear train taken at a line A-A in FIG. 2.
FIG. 4B is an enlarged view of an encircled portion in FIG. 4B.
Figures 5A, 5B:
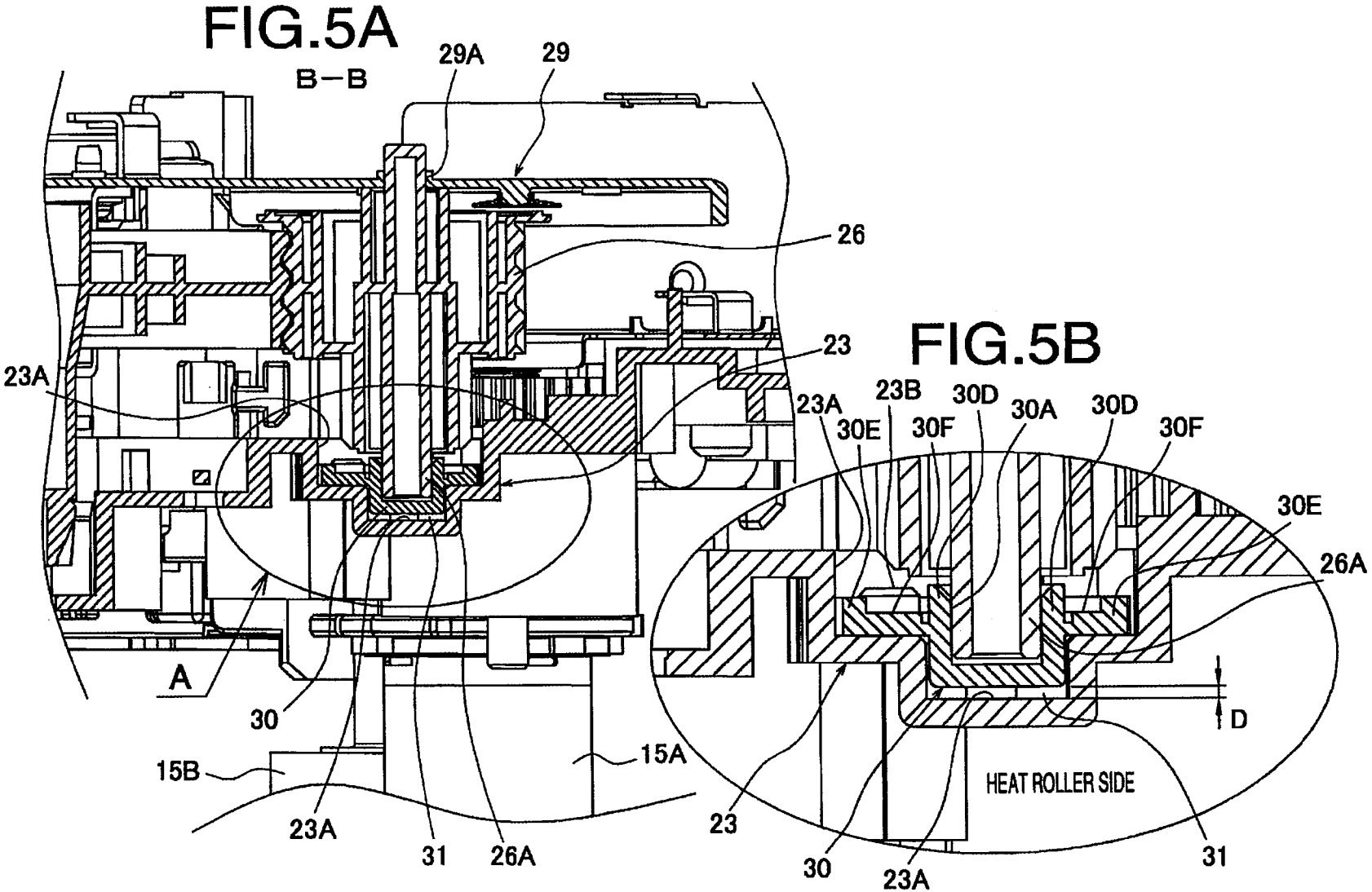
FIG. 5A is a cross-sectional view of the gear train taken a line B-B in FIG. 2.
FIG. 5B is an enlarged view of an encircled portion in FIG. 5B.
Figure 7:
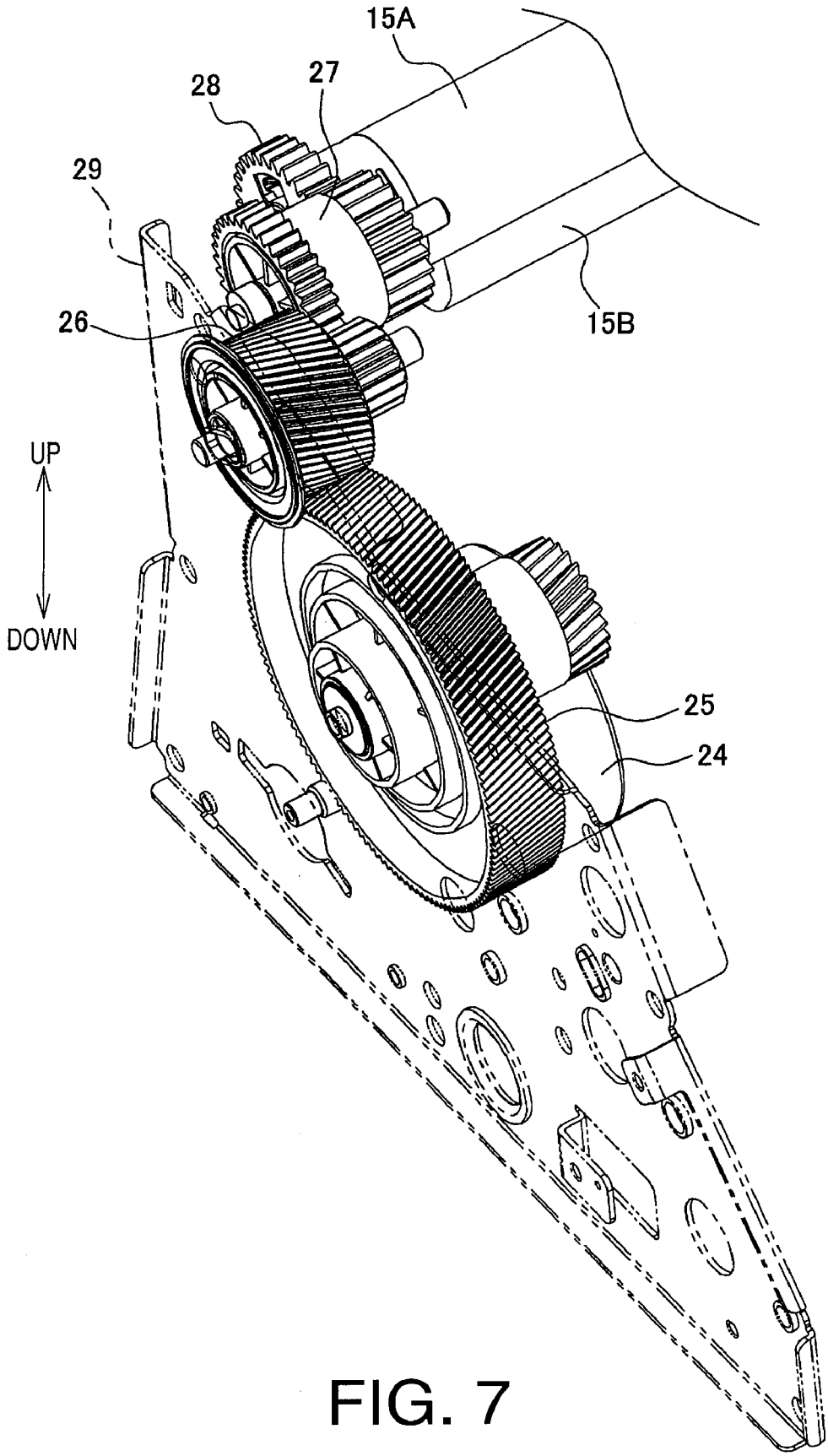
FIG. 7 is a perspective view of the gear train according to the embodiment of the present invention.
Figure 8:
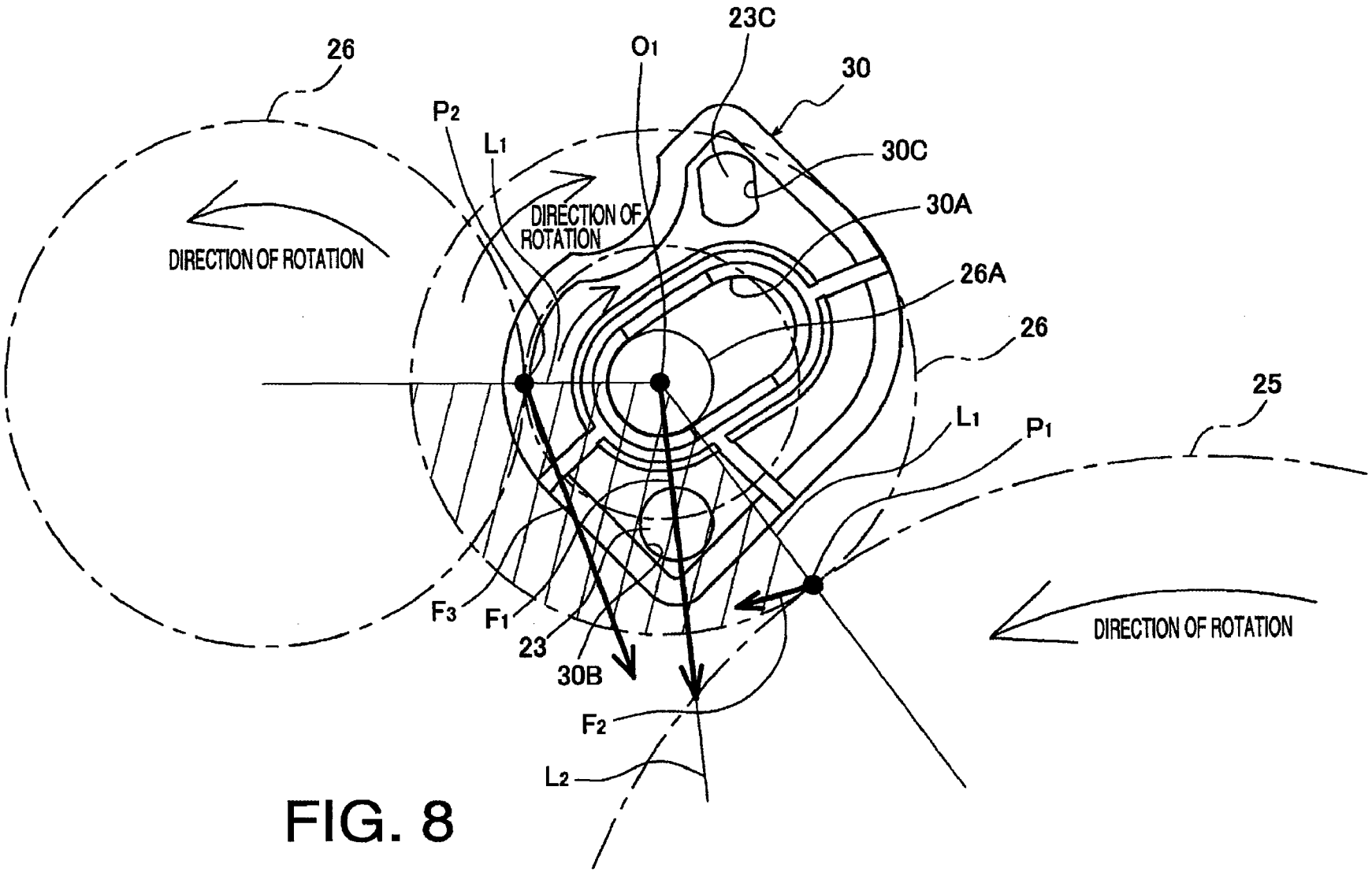
FIG. 8 illustrates movements of the gear train in the laser printer according to the embodiment of the present invention.
Figure 9A:
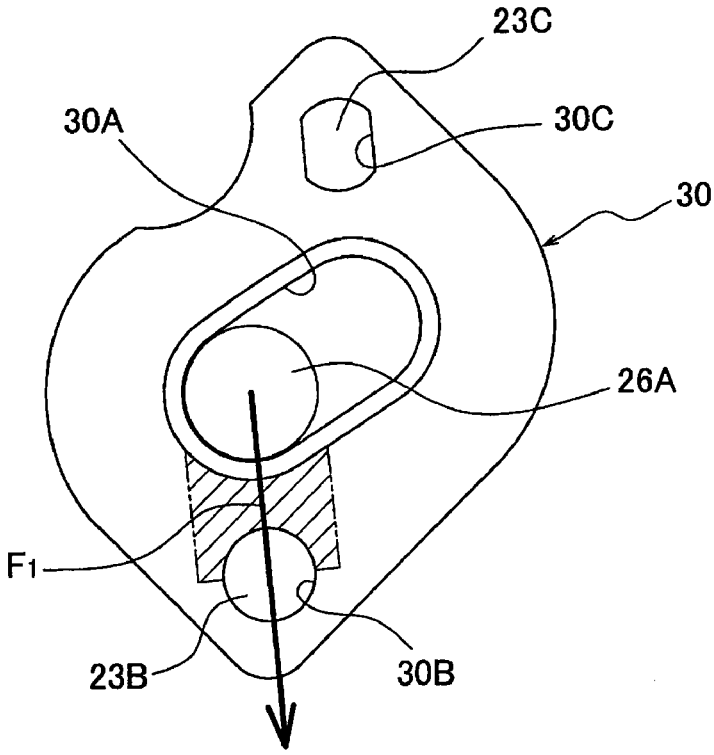
FIG. 9A illustrates a movement of the bearing in the laser printer according to the embodiment of the present invention.
Figure 9B:
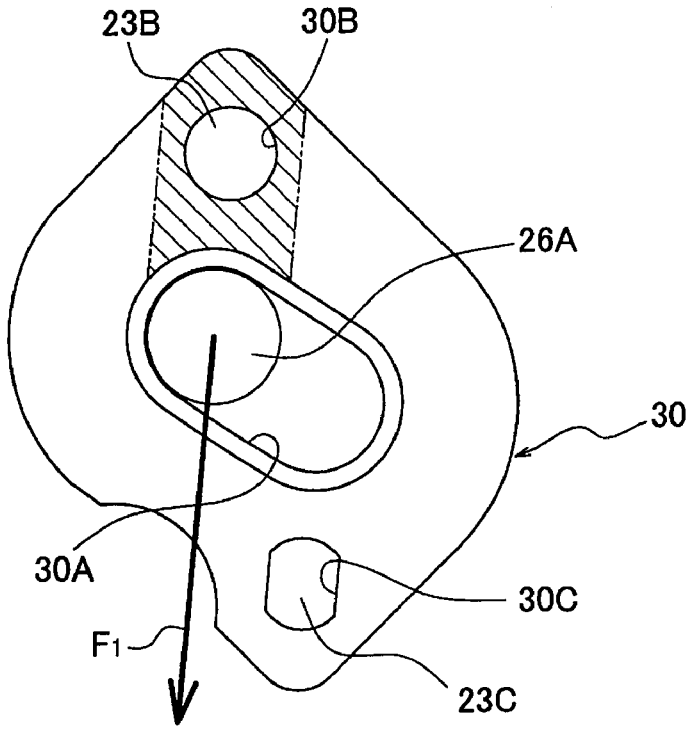
FIG. 9B illustrates a comparative movement of the bearing in the laser printer according to the embodiment of the present invention.

A power transmitting system to rotate the heat roller 15A will be described with reference to FIGS. 2-9. FIG. 2 is a front view of the gear train to drive the heat roller 15A in the laser printer 1 according to the embodiment of the present invention. FIG. 3 is an exploded view of a clutch gear 26, a bearing 30, and the side frame 23 in the laser printer 1 according to the embodiment of the present invention. FIG. 4A is a cross-sectional view of the gear train taken at a line A-A in FIG. 2, and FIG. 4B is an enlarged view of an encircled portion in FIG. 4B. FIG. 5A is a cross-sectional view of the gear train taken a line B-B in FIG. 2, and FIG. 5B is an enlarged view of an encircled portion in FIG. 5B. FIG. 6 is a front view of the gear train to drive the heat roller in the laser printer 1 according to the embodiment of the present invention. FIG. 7 is a perspective view of the gear train according to the embodiment of the present invention. FIG. 8 illustrates movements of the gear train in the laser printer 1 according to the embodiment of the present invention. It is to be noted that FIG. 9A illustrates a movement of the bearing 30 in the laser printer 1 according to the embodiment of the present invention. FIG. 9B illustrates a comparative movement of the bearing 30 in the laser printer 1 according to the embodiment of the present invention. FIGS. 2-9 show solely one of two sets of the gear trains, each of which is arranged on the respective ends of the heat roller 15A, and solely one of the two gear trains will be described hereinbelow.

The gears 25, 26 are arranged on an opposite side (closer to the casing 5) with respect to the heat roller 15A, with the side frame 23 in between. The gear 27 penetrates through the side frame 23 and is engaged with the clutch gear 26 at one axial end thereof and with the gear 28 at the other axial end thereof. The gear 28 is integrally rotatable about the axis of the heat roller 15A.

One end of a rotation shaft of the gear 25 is rotatably supported by a bearing provided to the side frame 23, and the other end is rotatably supported by a bearing provided to a plate 29, which is fixed to the side frame. Similarly, one end of a rotation shaft of the clutch gear 26 is rotatably supported by a bearing provided to the side frame 23, and the other end is rotatably supported by a bearing 30 provided to a plate 29, which is fixed to the side frame 23.

The bearing 30 is a slide bearing to support the clutch gear 26 rotatably is manufactured separately from the side frame 23 and fixed to the side frame 23 thereafter. The bearing 30 according to the present embodiment is made of a material (e.g., polyoxymethylene) having sliding resistance, which is lower than sliding resistance of a material for the side frame 23.

The side frames 23 according to the present embodiment is made of resin (e.g., ABS), and the plate 29 is made of a metal such as cold-rolled steel plate. The bearings including the bearing 30 are sliding bearings.

The bearing 30 is formed to have an oval recess 30A (see FIGS. 2, 3, and 6), which is a concave closed to the side frame 23. The bearing 30 is assembled to have a center of the recess 30A to correspond to a rotation axis of the clutch gear 26. Similarly, the plate 29 is formed to have an oval opening 29A (see FIG. 4A) and is assembled to have a center of the opening 29A to correspond to the rotation axis of the clutch gear 26. One end of a rotation shaft 26A of the clutch gear 26 is received to be slidably rotated in the recess 30A, and the other end of the rotation shaft 26A is received to be slidably rotated in the opening 29A.

Accordingly, as the clutch gear 26 is rotated, circumferences of the ends of the rotation shaft 26A are rotated and slid along inner peripherals of the recess 30A and the opening 29A respectively. Further, the clutch gear 26 can be shifted along the recess 30A and the opening 29A in a longitudinal direction of the recess 30A and the opening 29A.

Therefore, when the clutch gear 26 is in an engaged position indicated by a solid line in FIG. 6, the clutch gear 26 is engaged with the gear 25 and the gear 27 so that driving force provided by the motor 24 is conveyed to both of the gears 25 and 27.

When the clutch gear 26 is in a separated position indicated by a double-dotted line in FIG. 6, the clutch gear 26 is engaged solely with the gear 25 but is separated from the gear 27. Therefore, the driving force from the motor 24 is not conveyed to the gear 27. Thus, the clutch gear 26 serves to switch conveyance and shutting down the driving force from the motor 24 to the heat roller 15A.

In the present embodiment, it is to be noted that when driving force to rotate the heat roller 15A in a normal direction is conveyed to the clutch gear 26, force F1 is generated in an engaged portion of the gear 25 and the clutch gear 26; therefore, the clutch gear 26 moved to the engaged position remains therein to rotate the driving force to the gear 27 while the driving force is provided. The normal direction in the present embodiment refers to a direction, which can feed the recording sheet to the discharge tray 1A.

In other words, when driving force to rotate the heat roller 15A in a reverse direction is conveyed to the clutch gear 26, reverse force F2 is generated in the engaged portion of the gear 25 and the clutch gear 26; therefore, the clutch gear 26 is moved to the separated position, and the driving force is not conveyed to the gear 25.

The side frame 23 is formed to have a recessed portion 23A, in which the bearing 30 is to be attached (see FIG. 5A). As shown in FIG. 5A, the side frame 23 and the bearing 30 are assembles to have a clearance 31. The clearance 31 extends in an area corresponding to a shape of the recess 30A. Therefore, a shape of the clearance 31 substantially corresponds to the area of the recess 30A which faces to the recessed portion 23A of the side frame 23, i.e., an oval identical to the shape of the recess 30A.

As shown in FIG. 3, the bearing 30 is formed to have a shape similar to a rhomboid, when taken from an axial direction of the rotation shaft 26A (when assembled). Further, the bearing 30 is formed to have a first hole 30B, in which a first projection 23B of the recessed portion 23A is fitted, and a second hole 30B, in which a second projection 23C of the recessed portion 23A is fitted. The first projection 23B is a supporting portion to support the bearing 30 in the recessed portion 23A of the side frame 23.

Thus, the bearing 30 can be guided to be set in the recessed portion 23A of the side frame 23 based on the position of the first projection 23B. When the bearing 30 is set in the recessed portion 23A, the first projection 23B fitted in the first hole 30B is subjected to the force to the bearing 30 and supports the bearing 30.

The second projection 23C is in a position opposite from the first projection 23B with respect to first virtual lines L1, which will be described later. When the bearing 30 is set in the recessed portion 23A with the second projection 23C fitted in the second hole 30C, the bearing 30 can be prevented from being rotated about the first projection 23B and stopped at the correct position.

As shown in FIG. 8, one of the first virtual lines L1 refers to a line between a point P1, in which the gear 25 and the clutch gear 26 are engaged, and a rotation axis O1 of the clutch gear 26. The other one of the first virtual lines L1 refers to a line between a point P2, in which the gear 27 and the clutch gear 26 are engaged, and the rotation axis O1 of the clutch gear 26.

The first projection 23B (i.e., the first hole 30B) is in a shaded area in FIG. 8, between the first virtual lines L1 through which an operating pressure F1 passes, and in a position passing through a second virtual line 2. The second virtual line L2 refers to a line which is parallel with the direction of the operating pressure F1 and passes through the rotation axis O1 of the clutch gear 26. The operating pressure is rotating force to rotate gears and generated in an engaged portion of the gears. According to the present embodiment, the clutch gear 26 is engaged with the gear 25 and the gear 27 at the point P1 and P2 respectively, and operating pressure F2 and F3 are generated in the respective points P1 and P2. In the present embodiment, resultant force of the operating pressures F2 and F3 is referred to as the operating pressure F1.

The bearing 30, specifically as shown in FIG. 3 and FIG. 4B, is further formed to have an inner edge 30D, an outer edge 30E, flange portions 30F, and ribs 30G, which are integral in the bearing 30. The inner edge 30D corresponds to the inner peripheral of the recess 30A, and the flange portions 30F extend to connect the inner edge 30D with the outer edge 30E. The first hole 30B and the second hole 30C are formed in the flange portions 30F. The flange portions 30F are in an approximate center in depth of the recess 30A. The ribs 30G are formed on the flange portions 30F.

The bearing 30 according to the present embodiment is made of a material, of which sliding resistance is smaller than sliding resistance of the side frame 23; therefore, frictional heat caused in the bearing 30 can be maintained lower. Accordingly, deformation of and/or damage to the bearing 30, which may otherwise be caused by the frictional heat, can be prevented.

It is to be noted that the bearing 30 may be integrally formed with the side frame 23, and the side frame 23 can be made of the material, of which sliding resistance is smaller. However, the side frame 23 and the bearing 30 in such a configuration may increase material cost for the low sliding-resistance material.

According to the present embodiment, the bearing 30 is made separately from the side frame 23 so that solely the bearing 30 can be made of the low sliding-resistance material which may cost higher than the material of the side frame 23. Therefore, the material cost for the entire laser printer 1 including the side frames 23 and the bearing 30 can be suppressed to be lower while the frictional heat in the bearing 30 can be maintained lower.

Further, the bearing 30 is set on the opposite side of the side frame 23 with respect to the heat roller 15A so that the heat from the heat roller 15A is not directly transferred to the bearing 30. In addition, the clearance 31 between the bearing 30 and the heat roller 15A prevents the heat to be transferred to the bearing 30.

According to the present embodiment which has been described above, resistance quality against heat deformation and abrasion can be improved. It is to be noted that distance D (see FIG. 5B) between the bearing 30 and the side frame 23 is preferable to be approximately 0.8 mm or larger, although the distance D may vary according to the material of the bearing 30.

In the present embodiment, the first projection 23B to locate the bearing 30 in the correct position is provided in the area between the first virtual lines L1, and through which the operating pressure F1 passes so that the portion between the center of the bearing 20 and the first projection 23B (i.e., the first hole 30B) is subjected to the operating pressure F1 caused by the compressing force generated in a shaded area in FIG. 9A (see FIG. 9A).

It is to be noted that, if the bearing 30 is configured to be subjected to the operating pressure F1 caused by tensile force, a shaded portion in FIG. 9B is subjected to the operating pressure F1.

Thus, the portion to be subjected to the operating pressure F1 being the compressing force, as shown in FIG. 9A, can be smaller than a portion to be subjected to the operating pressure F1 being the tensile force, which is shown in FIG. 9B. Therefore, according to the present embodiment, an entire size of the bearing 30 can be smaller.

Further, it is to be noted that the first projection 23B is arranged on the second virtual line L2, which is parallel with the direction of the operating pressure F1 and passes through the rotation axis O1 of the clutch gear 26, when the bearing 30 is assembled. Therefore, the first projection 23B can receive the operating pressure effectively. Thus, the first projection 23B serves to locate the bearing 30 in the correct position so that no unnecessary bending stress can be prevented from being generated.

It is further to be noted that the bearing 30 is formed to have the flange portion 30F to extend to surround the first projection 23B in the approximate center in the depth of the recess 30A. According to this structure, unnecessary bending moment, which can be caused by contact stress (Hertz stress) generated in the contact portion of the bearing 30 and the rotation shaft 26A, can be prevented from occurring. Therefore, torsional deformation of the flange portion 30F or the first projection 23B can be prevented from occurring.

In the present embodiment, the shape of the clearance 31 at least corresponds to the area of the recess 30A. Therefore, heat transfer from the heat roller 15A to the bearing 30 can be effectively obstructed so that increase of temperature in the bearing 30 can be avoided.

Although an example of carrying out the invention has been described, those skilled in the art will appreciate that there are numerous variations and permutations of the printing apparatus that falls within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the printing apparatus to which the present invention is applied is not necessarily a monochrome laser printer, but may be a color laser printer, and a color/monochrome inkjet printer. Further, the present invention may be applied to a color or monochrome facsimile machine.

For another example, in the above embodiment, the photosensitive drum 11A is exposed to the laser beam in order to form the latent image thereon; however, the photosensitive drum 11A may be exposed to a plurality of LEDs to form the latent image alternatively to the laser beam.

In the above embodiment, the clutch gear 26 can be engaged with two gears, which are the gears 25, 27. However, the number of gears to be engaged with the clutch gear 26 may be one, three, or more.

Further, the positions of the first projection 23*b* and the second projection 23C may be altered.

Furthermore, the gear to which the present invention is applied is not limited to the clutch gear 26, but the present invention can be additionally applied to the other gears.

What is claimed is:

1. An image forming apparatus to form an image on a recording sheet by transferring electrophotographic developer onto the recording sheet, comprising:

a heat roller to thermally fix the transferred developer onto the recording sheet;

a rotating member to convey rotation force to the heat roller;

a bearing to support the rotating member rotatably;

a frame in which the bearing is assembled so that the rotating member is supported by the frame through the bearing;

wherein the bearing is made of a material having sliding resistance lower than sliding resistance of a material of the frame;

wherein the bearing is arranged on an opposite side of the heat roller with respect to the frame and receives the rotating member on the opposite side; and wherein the bearing and the frame are assembled to have clearance therebetween.

2. The image forming apparatus according to claim 1, wherein the frame is formed to have a supporting portion to guide a position of the bearing in the frame when the bearing is assembled with the frame, the supporting portion being subjected to force conveyed to the bearing;

wherein the rotating member is a first gear to be engaged with at least one second gear and rotated by rotating force provided by the at least one second gear; and wherein the supporting portion is positioned in an area defined by first virtual lines and in which a direction of operating pressure caused by rotation of the first gear and the at least one second gear passes, the first virtual line being a line between an engaging point of the first gear with the at least one second gear and a rotation axis of the first gear.

3. The image forming apparatus according to claim 2, wherein the supporting portion is provided in a position on a second virtual line, which is parallel with the direction of the operating pressure and passes through the rotation axis of the first gear.

4. The image forming apparatus according to claim 2, wherein the bearing is formed to have a recess with an inner peripheral, along which a circumference of a shaft of the first gear is rotatably slid; and wherein the bearing is formed to have a flange portion to extend to surround the supporting portion in an approximate center in depth of the recess.

5. The image forming apparatus according to claim 4, wherein the clearance extends at least in an area corresponding to a shape of the recess.

6. The image forming apparatus according to claim 4, wherein the recess of the bearing is formed to have a shape of an approximate oval: and wherein the shaft of the first gear can be shifted in a longitudinal direction of the oval-shaped recess.

7. The image forming apparatus according to claim 2, wherein the frame is formed to have a stopper portion, by which the bearing is prevented from being rotated about the supporting portion, in a position opposite to the projection with respect to the first virtual lines.

8. The image forming apparatus according to claim 2, wherein the supporting portion is a projection to guide the position of the bearing in the frame.

* * * * *